US005115632A

United States Patent [19]

Ulmer

[11] Patent Number: 5,115,632

[45] Date of Patent: May 26, 1992

[54] RING SPINNING MACHINE AND METHOD OF OPERATING A RING SPINNING MACHINE

[75] Inventor: Georg Ulmer, Nuerensdorf, Switzerland

[73] Assignee: Rieter Machine Works, Ltd., Winterthur, Switzerland

[21] Appl. No.: 500,759

[22] Filed: Mar. 28, 1990

[30] Foreign Application Priority Data

Mar. 29, 1989 [DE] Fed. Rep. of Germany ..... 3910182

[51] Int. Cl.[5] ..... D01H 7/46; D01H 13/00

[52] U.S. Cl. ..... 57/264; 57/98

[58] Field of Search ..... 57/98, 264, 277, 95, 57/265, 79, 99; 364/142, 565; 377/17; 340/870.29

[56] References Cited

U.S. PATENT DOCUMENTS

| | | | |
|---|---|---|---|
| 3,075,342 | 1/1963 | Lohest et al. | 57/277 |
| 3,477,654 | 11/1969 | Tonnies | 57/99 |
| 3,604,643 | 9/1971 | Kimura et al. | 57/277 |
| 3,768,244 | 10/1973 | Yasutomi et al. | 242/26.1 X |
| 3,825,900 | 7/1974 | Anderson | 66/75.2 X |
| 3,950,927 | 4/1976 | Kallman | 57/265 |
| 3,988,879 | 11/1976 | Franzolini et al. | 57/265 |
| 4,023,342 | 5/1977 | Schenkel | 57/265 |
| 4,122,654 | 10/1978 | Oswald | 57/99 |
| 4,510,570 | 4/1985 | Yonekura | 364/142 |
| 4,592,197 | 6/1986 | Wolf | 242/26.1 X |
| 4,715,009 | 12/1987 | Bohmler et al. | 364/565 |

FOREIGN PATENT DOCUMENTS

| | | | |
|---|---|---|---|
| 0049013 | 4/1982 | European Pat. Off. | 57/264 |
| 2124447 | 12/1971 | Fed. Rep. of Germany . | |
| 2927616 | 1/1981 | Fed. Rep. of Germany . | |
| 3017837 | 11/1981 | Fed. Rep. of Germany . | |
| 3336040 | 4/1985 | Fed. Rep. of Germany . | |
| 3706513 | 9/1987 | Fed. Rep. of Germany . | |
| 1006126 | 1/1989 | Japan | 57/277 |
| 1160972 | 8/1969 | United Kingdom | 57/266 |

OTHER PUBLICATIONS

Rebsamen, Arthur, "New Possibilities of Bobbin Building with Microprocessors", Meilland Textilberichte, Jun., 1985, pp. 438–444.

Zuend, Marcel, "Microelectronics–Present and Future Applications in Spinning", Meilland Textil Berichte, Jun. 1985, pp. 426–437.

Patent Abstracts of Japan, vol. 4, No. 101 (C-19) (583) Jul. 19, 1980 and JP-A-55 062219 (Howa Kogyo), May 10, 1980.

*Primary Examiner*—Daniel P. Stodola
*Assistant Examiner*—John F. Rollins
*Attorney, Agent, or Firm*—Wyatt, Gerber, Burke & Badie

[57] ABSTRACT

A method is described of operating a ring spinning machine in which the traversing motion of the ring rail is generated by means of a heart-shaped disc. For the execution of specific functions which depend on the angular position of the heart-shaped disc, the period of rotation of the heart-shaped disc is first determined. Thereafter, a predetermined angular starting position of this heart-shaped disc is detected and, on the basis of the predetermined period of rotation, the time is then computed in each case from the occurrence of the angular starting position up to the occurrence of at least one further predetermined angular position which is associated with a respective function. On the expiration of the time associated with a respective angular position, the related function is executed.

22 Claims, 2 Drawing Sheets

RING SPINNING MACHINE AND METHOD OF OPERATING A RING SPINNING MACHINE

Figure 1:
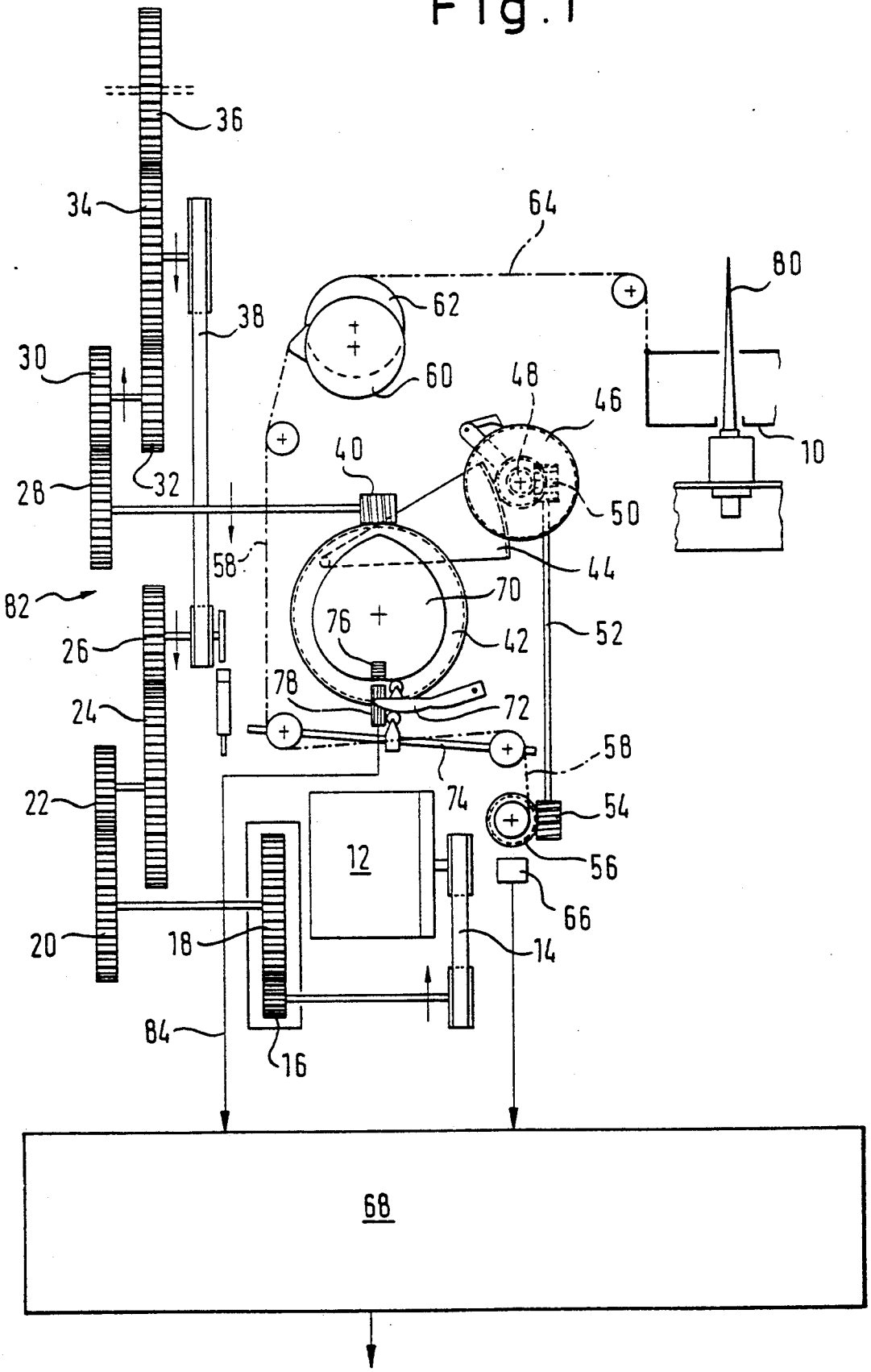

The invention relates to a ring spinning machine and to a method of operating a ring spinning machine.

Heretofore, various types of ring spinning machines have been known for the winding of thread onto bobbins on spindles to form a multiplicity of cops. For example, ring spinning machines have been constructed with a ring rail which is generally associated with a plurality of spindles and which mainly extends over the full length of the ring spinning machine. In order to generate a specific cop build-up, come a ring rail of this kind is continuously moved upwardly during the building of the yarn package on the cop and a so-called traversing motion, which can be generated by means of rotating heart-shaped disc serving as a cam track, is superimposed on this continuous movement of the ring rail. This repetitive up and down traversing motion leads to the formation of the desired conical layers on the cop. After the yarn package has been completed, the ring rail is lowered to permit doffing of the finished cops.

In the practical operation of a ring spinning machine, it is frequently necessary to execute specific functions, such as for example the switching off of the machine, the slowing down of the machine, in particular of the spindles, the generation of top and bottom windings and also a layer regulation, which largely determines the thread breakage behavior, in dependence on the prevailing position of the ring rail and the prevailing direction of movement of the ring rail, in particular during the traversing motion.

Accordingly, it is an object of the invention to control the respective machine functions in dependence on the position and/or direction of motion of the ring rail in the simplest manner and in a reliable manner without increased cost and complexity of the apparatus.

Briefly, the invention provides a method of operating a ring spinning machine having a ring rail, a plurality of driven spindles on the ring rail and a rotatable heart-shaped cam disc for generating a traversing motion in the ring rail. In accordance with the method, the time required for one revolution of the heart-shaped disc is determined; a predetermined angular starting position of the heart-shaped disc is detected; and, starting from a predetermined time of rotation, the time is in each case computed from the occurrence of the angular starting position up to the occurrence of at least one further predetermined angular position, with specific machine functions being associated with the predetermined angular positions. In addition, on the expiration of the time associated with a respective angular position, the relevant machine function is executed.

In accordance with the invention, the time at which an angular position of the heart-shaped disc occurs which is associated with a relevant machine function is in each case computed on the basis of the time required for one revolution of the heart-shaped disc. The execution of the respective function takes place in dependence on the expiration of the time associated with the relevant angular position. For the initiation of functions at the correct time it is only necessary to define and detect a single predetermined angular starting position of the heart-shaped disc, the occurrence of which specifies the point in time at which the time associated with a relevant machine function starts to run. A particular advantage of this is that it is only necessary to arrange a single marking or the like on the heart-shaped disc in order to specify an angular starting position of this kind, with the single marking being detected by a sensor at the relevant angular starting position. This sensor thus delivers a time reference signal on the occurrence of the angular starting position of the heart-shaped disc so that the start of each period of time, and thus also the point in time at which the relevant function must be executed, are always precisely defined and associated with the corresponding ring rail positions.

The ratio of a particular time value to the total time of revolution is the same as the ratio of the associated angular position to 360°. In order to determine the respective time values, it is thus only necessary to carry out a simple computation by way of a simple equation (rule of three). A specific machine function can also expediently be associated with the angular starting position of the heart-shaped disc, with this machine function then being executed when the angular starting position is detected. If the occurrence of the angular starting position, in turn, delivers the time reference point then the time setting associated with the function is equal to zero.

Although it is not absolutely essential to detect the angular starting position for the determination of the time of revolution of the heart-shaped disc, it can nevertheless be expedient for the measurement of the time of rotation of the heart-shaped disc to determine the time between a first detection of the angular starting position and a subsequent detection of this angular starting position.

For predetermined, and in particular preprogrammed speeds of rotation, the time associated with a respective angular position of the heart-shaped disc can however advantageously be determined in advance even without measuring the time of rotation.

On stopping the ring spinning machine, the different drives are expediently first brought from the operating speed to a relatively low speed of rotation. This speed of rotation can for example correspond to the same desired frequency which is used on starting up for the synchronizing of the motors. The speed of rotation is accordingly set to the lower value before certain functions are executed which are required directly prior to switching off of the machine.

In such cases, provision is preferably made for the measurement of the time of rotation of the heart-shaped disc to take place while the higher speed of rotation still prevails, and for the time associated with a particular angular position to be determined from the time of rotation for the higher speed of rotation, with the time associated with the same angular position for the lower speed of rotation then being determined by extrapolation from the first determined time value. In this way, one ensures that the time values which are associated with the functions which still have to be executed are already present on reaching the lower speed of rotation, so that it is only necessary to wait for the occurrence of the angular starting position which in turn delivers the time reference value for the further control.

In this respect, it is furthermore of advantage to detect the first occurrence of the angular starting position of the heart-shaped disc directly after reaching the lower speed of rotation and to execute the relevant machine function on the expiration of a time associated with the respective angular position, with the time being measured from the instant of the first detection of the angular starting position.

In order to maintain a certain thread tension even on stopping of the machine, the stopping of the machine preferably takes place while the ring rail is moving continuously downwardly, with the corresponding machine function being associated with an angular switch off position of the heart-shaped disc.

Provision is expediently also made, for the execution of several top windings after the respective cop build-up has been completed. For this purpose, the corresponding machine function is executed in dependence on the expiration of a time associated with at least one angular top winding position of the heart-shaped disc. The production of the top windings can, for example, take place during raising of the ring rail.

The production of the top windings can take place starting from a downwardly directed traversing motion of the ring rail.

After completion of the respective cop build-up, i.e. completion of the yarn package wound on the sleeve, bottom windings can also be expediently produced, with the corresponding machine function being executed in dependence on the expiration of a time associated with at least one angular bottom winding position of the heart-shaped disc. The function is also again executable here, for example, by a variation of the level of the ring rail.

In corresponding manner, the braking of the machine and in particular the braking of the spindles can take place on the expiration of a time associated with an angular brake switching-in position of the heart-shaped disc.

Furthermore, provision is expediently made for the layer regulation to take place during the build-up of the cop in dependence on the expiration of the time associated with at least one angular layer regulation position of the heart-shaped disc.

The invention also provides a ring spinning machine comprising a plurality of driven spindles, a ring rail and a drive for the adjustment of the position of the ring rail. In addition, the drive includes a rotating heart-shaped cam disc which serves as a cam track for the generation of a traversing motion of the ring layer.

In accordance with the invention, the ring spinning machine of this kind is characterized in that the heart-shaped disc carries a marking to which a stationary sensor responds in order to detect a predetermined angular starting position of the heart-shaped disc; in that a control unit is provided in order to compute, starting from the time required for one revolution of the heart-shaped disc, in each case the time from the occurrence of the angular starting position up to the occurrence of at least one further predetermined angular position, with the predetermined angular positions being associated with specific machine functions; and in that the control unit is laid out to execute a respective machine function on the expiration of the time associated with the related angular position.

Accordingly, it is sufficient to arrange a single marking on the heart-shaped disc, with the marking lying opposite the sensor on the occurrence of a predetermined angular starting position of heart-shaped disc and being detected by the sensor to transmit a time reference signal.

The marking is preferably a cam or lug arranged on the heart-shaped disc and the sensor is a cam operated switch or an inductive proximity switch actuated by the cam.

A measurement device is expediently provided for the determination of the time required for a revolution of the heart-shaped disc, so that the actual time of rotation is also determinable during normal operation even with changing speeds of rotation.

Although the marking and also the sensor are not absolutely essential for determining the time of rotation, provision is made in accordance with a preferred variant for the measurement device to be formed by the sensor which responds to the marking and also at least in part by the control unit in order to determine, for the measurement of the time of rotation, the time between a first detection of the angular starting position and a subsequent detection of this angular starting position. Accordingly, the time is measured which elapses between two sequential pulses delivered by the sensor.

The control unit advantageously includes at least one timer which is settable or resettable on the occurrence of the angular starting position of the heart-shaped disc, in order to preset a time corresponding to a predetermined angular position.

The control unit can also include means for determining by extrapolation the time associated with a particular angular position for a lower speed of rotation from the time associated with the same angular position for a higher speed of rotation. This is of particular advantage when, for the switching off of the machine, the speed of rotation is first to be reduced to a lower value and the machine should subsequently be stopped as quickly as possible. The fact that the time values are already present on reaching the lower speed of rotation means that after entering the operating phase associated with the lower speed of rotation it is only necessary to wait for the occurrence of the angular starting position in order to thereafter directly monitor the expiration of the respective times and to correspondingly execute the still remaining operating steps.

The control unit of the ring spinning machine of the invention preferably includes at least one microprocessor.

Figure 2:
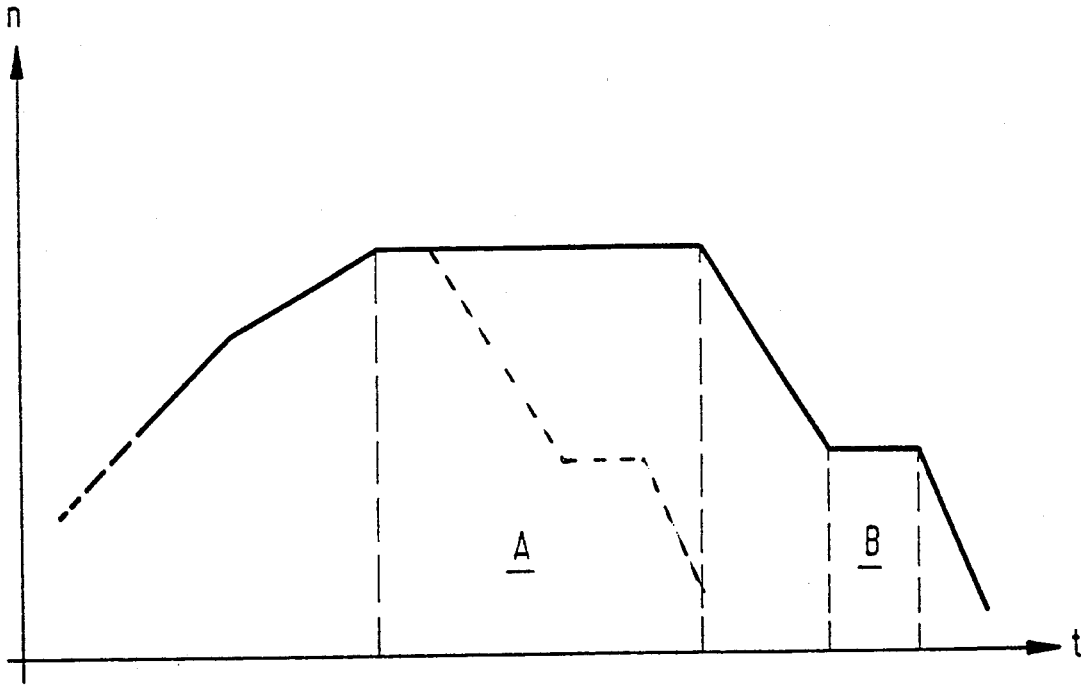

The invention will now be explained in more detail in the following with reference to an embodiment and to the drawing in which are shown:

FIG. 1 illustrates a schematic of a drive for the adjustment of the ring rail of a ring spinning machine having a control unit in accordance with the invention; and FIG. 2 graphically illustrates a sequence of events for the starting up and stopping of the ring spinning machine.

FIG. 1 schematically illustrates the drive 82 for adjusting the position of a ring rail 10 associated with a plurality of spindles 80 and also for the nonillustrated drafting mechanism of a ring spinning machine.

In this ring spinning machine, the adjustment of the ring rail 10 and also the driving of the drafting mechanism takes place by means of a frequency controlled motor 12. This motor 12 operates on the ring rail 10 and on the drafting mechanism via belts 14, 38 and meshing gear wheels 16 to 36. The drive connection, to the drafting mechanism (not shown) takes place via the axle of the gear wheel 36 which is illustrated in broken lines.

The drive for the adjustment of the position of the ring rail 10 is branched off from the gear wheel 28 which is set into the drive chain.

The gear wheels 28 and 30 drive a worm 40 which meshes with and drives a worm wheel 42 to execute a continuous rotary movement. The worm wheel 42 is coupled via nonillustrated means with a ratchet 44 which imparts rotation to a gear wheel 46.

A further worm wheel 48 is arranged coaxial to the gear wheel 46 and is fixedly coupled therewith. The worm wheel 48 drives a worm 50 which drives a further worm 54 via a shaft 52. This worm 54, in turn, meshes with a worm wheel 56.

The worm wheel 56 is coupled to one end of a tape 58 and winds up this tape 58 in correspondence with the rotary movement of the worm 54.

The other end of the tape 58 is coupled to a wheel 60, with the winding up of the tape 58 by the worm wheel 56 leading to a rotary movement of the wheel 60.

A further wheel 62 is coupled to the wheel 60 and a further tape 64 is secured to the wheel 62. This tape 64 is fixedly connected at the other end to the ring rail 10.

The rotation of the worm 40 accordingly adjusts the level of the ring rail 10.

An incremental transducer 66 is associated with the worm wheel 56 and transmits a pulse sequence which is supplied to a central control unit 68. The control unit 68 can determine from this pulse sequence the prevailing level of the ring rail 10 which is brought about by the continuous movement.

A so-called heart cam or heart-shaped disc 70 is arranged on the worm wheel 42 and serves as a cam track for the generation of a traversing motion of the ring rail 10. For this purpose, the heart-shaped disc 70 brings about a to and fro movement of a traversing arm 72 which leads repeatedly through adjustment of a rocker lever 74 to a shortening or lengthening of the band 58 between the worm wheel 56 and the wheel 60 whereby a corresponding to and fro movement of the ring rail 10 is generated, i.e. an up and down traversing motion.

On this heart-shaped disc 70, there is arranged a cam 76 as a marking which energizes a cam switch 78 serving as a sensor once per revolution of the heart-shaped disc 70. The sensor 78 delivers a pulse to the central control unit 68 via a line 84 once per revolution. The control unit 68 receives information via this signal on the time at which a predetermined angular starting position of the heart-shaped disc 70 occurs. This initial angular position can, for example, be present by the start or the end of a respective stroke of the traversing motion. The purpose of this information (from 66 & 78) is to place the control unit 68 in the position of being able to set the rotational speed of the spindles 80 in dependence on the level of the ring rail 10 during the continuous ring rail adjustment and to vary the speed of rotation in accordance with the traversing motion as will be described in detail further below. As illustrated, a driving system 86 is associated with the spindles 80 and is correspondingly set by the control unit 68.

The ring spinning machine is operated as follows:

First of all, the time required for one revolution of the heart-shaped disc 70 is determined. This time of revolution can already be present for predetermined and in particular pre-programmed speeds of rotation, so that a special measurement is not necessary in every case.

On the other end, the time between a first detection of the angular starting position of the heart-shaped disc 70 and a subsequent detection of this angular starting position can, for example, also be determined for the measurement of the time of rotation of the heart-shaped disc 70. The preset angular starting position is detected in that the cam operated switch 78 serving as the sensor responds to the marking or to the cam 76 on the heart-shaped disc 70 as soon as the latter adopts the said angular position.

Once the time of revolution of the heart-shaped disc 70 is present, the time is computed, starting from this time of rotation, from the occurrence of the angular starting position up to the occurrence of at least one further predetermined angular position, with specific machine functions being associated with the predetermined angular positions. The relevant machine function is executed on the expiration of the time associated with the respective angular position. The detection of the initial angular position of the heart-shaped disc 70 by means of the cam 76 and the cam operated switch 78, which delivers a corresponding signal to the control unit 68, accordingly serves for the generation of a time reference signal on the occurrence of which the time starts to run which is associated with the occurrence of a particular function. The angular starting position of the heart-shaped disc 70 in which the cam 76 lies opposite to the cam operated switch 78 can basically also be associated with a specific machine function. This machine function is then executed on detecting the angular starting position.

In the present embodiment, the stopping of the machine takes place while the ring rail 10 moves steadily downwards. For this purpose, an angular switch off position of the heart-shaped disc 70 is associated with the corresponding machine function.

The execution of this function and also of the further functions takes place in dependence on the time set which results from simple calculation from the time of rotation and also from the angle. The ratio of the relevant angle to 360° is namely the same as the ratio of the relevant time to the period of rotation.

Top windings are generated after completion of the respective build-up of the cop. During this, the corresponding machine functions, in particular the lifting of the ring rail 10, are executed in dependence on the expiration of the time associated with at least one angular top winding position of the heart-shaped disc.

The angular top winding position of the heart-shaped disc is selected such that the production of the top windings takes place starting from a downwardly directed traversing motion of the ring rail 10.

Furthermore, after completion of the respective build-up of the cop, bottom windings are also generated, with the corresponding machine function or the lowering of the ring rail 10 being executed in dependence on the expiration of the time associated with at least one angular bottom winding position of the heart-shaped disc 70.

The machine and, in particular the spindles 80 are braked on expiration of the time associated with an angular brake switch-in position of the heart-shaped disc.

Furthermore, at least one angular layer regulation position of the heart-shaped disc can be preset, with the layer regulation taking place during the cop build-up in dependence on the expiration of the time associated with this angle.

A measuring device for the determination of the period of rotation of the heart-shaped disc 70 required for one revolution can be formed by the cam operated switch 78 which responds to the cam 76, and also at least in part by the control unit 68 which, for the measurement of the period of rotation, determines the time between a first detection of the angular starting position and a subsequent detection of this angular starting position.

The electronic control unit 68 expediently includes at least one timer which can be respectively set or reset on the occurrence of the angular starting position to preset a time corresponding to a predetermined angular position.

The control unit 68 can be formed by at least one microprocessor.

In practical operation, the speed of rotation of the machine is first reduced to a lower value before the machine is stopped. The operating phase of a lower speed of rotation is designated with B in the scheme of events illustrated in FIG. 2 for the starting up and stopping of the ring spinning machine. During normal operation in the phase A, the machine is operated at a higher speed of rotation.

Since functions such as for example the production of top and bottom windings, the stopping of the machine and also the switching in of the braking are also executed during operation with the lower speed of rotation in the phase B, the period of rotation for these lower speeds of rotation must be determined for the calculation of the time values for the lower speed of rotation and the time values computed from this period of rotation. Alternatively the time values for the lower speed of rotation must be computed from the time values which result for the higher speed of rotation.

In the described embodiment, provision is made for carrying out the measurement of the period of rotation of the heart-shaped disc 70 during the higher speed of rotation. The time associated with a particular angular position for the higher speed of rotation is determined from this period of rotation. Subsequently, the time values associated with the same angular positions but for the lower speed of rotation are computed by extrapolation from the first determined time values.

Directly after attaining the lower speed of rotation, the angular starting position is then detected in order to then execute the relevant machine function on the expiration of a time associated with a particular angular position or function, with the time being measured from the instant of the first detection of the angular starting position.

For this purpose, the control unit 68 preferably includes means for determining by extrapolation the time associated with a particular angular position for a lower speed of rotation from the time associated with the same angular position for a higher speed of rotation. The extrapolation is executed in the control unit 68 which can be formed by at least one microprocessor.

Referring to FIG. 2, should a need arise to stop a ring spinning machine before the cops are full, phase B may be initiated at an earlier stage in the winding process as shown by the broken line. To this end, after a suitable switch has been activated to signal that the machine is to be stopped, the control unit 568 responds by resetting the time to begin the stopping phase.

What is claimed is:

1. A method of operating a ring spinning machine having a ring rail, a plurality of driven spindles on the ring rail, and a rotatable heart-shaped cam disc for generating a traversing motion in the ring rail; said method comprising the steps of determining the time required for one revolution of the cam disc;

detecting a predetermined angular starting position of the cam disc;

computing the time from the detection of said starting position to the occurrence of at least one further predetermined angular position corresponding to a specific machine function of the ring spinning machine; and executing said machine function upon expiration of said computed time.

2. A method as set forth in claim 1 wherein a second machine function associated with said angular starting position is executed in response to said detection of said starting position.

3. A method as set forth in claim 1 wherein the time required for one revolution of the cam disc is determined by the time required for two successive detections of said angular position of the cam disc.

4. A method as set forth in claim 1 wherein the time required for one revolution of the cam disc is predetermined for a predetermined speed of rotation.

5. A method as set forth in claim 1 wherein the cam disc contains a marking indicative of said starting position and a stationary sensor is used to detect the position of said marking.

6. A method as set forth in claim 1 which further includes the stage of reducing the speed of rotation of the cam disc to a predetermined value prior to switching off the machine and executing said machine function during said reducing step.

7. A method as set forth in claim 6 wherein the measurement of the time of rotation of the heart-shaped disc takes place while a high speed of rotation prevails; the time associated with a respective angular position is determined from the time of rotation for the high speed of rotation; and the time associated with the same angular position is determined for a lower speed of rotation by extrapolation from the first determined time value.

8. A method as set forth in claim 7 wherein the angular starting position is detected immediately after reaching the lower speed of rotation; and the associated machine function is executed on the expiration of the time associated with the respective angular position, the time being measured from the instant of the first detection of the angular starting position.

9. A method as set forth in claim 1 wherein stopping of the machine takes place while the ring rail moves continuously downwardly and an angular switch off position of the heart-shaped disc is associated with the corresponding machine function.

10. A method as set forth in claim 1 which further comprises the step of generating top windings after completing the respective build-up of a cop; and executing the corresponding machine function in dependence on the expiration of a time associated with at least one angular top winding position of the heartshaped disc.

11. A method as set forth in claim 10 wherein the generation of the top windings takes place starting from an upwardly directed traversing motion of the ring rail.

12. A method as set forth in claim 1 which further comprises the step of generating build-up bottom windings after completion of the respective cop and executing the corresponding machine function in dependence on the expiration of the time associated with at least one angular bottom winding position of the heart-shaped disc.

13. A method as set forth in claim 1 which further comprises the step of braking the spindles, on the expiration of a time associated with an angular braking initiation position of the heart-shaped disc.

14. A method as set forth in claim 1 which further comprises the step of regulating the layers of a cop build-up in dependence on the expiration of the time associated with at least one angular layer regulation position of the heart-shaped disc.

15. A ring spinning machine comprising a ring rail;

a plurality of driven spindles on said ring rail;

a drive for moving said ring rail in a continuous traversing motion, said drive including a heart-shaped cam disc for generating said motion;

a marking on said disc indicative of a predetermined angular starting position of said disc;

a stationary sensor for detecting said marking and generating a signal in response thereto; and a control unit connected to said sensor for receiving said signal therefrom and computing the time from said signal to at least one further predetermined angular position of said cam disc corresponding to a specific machine function, said control unit effecting execution of said machine function upon expiration of said computed time.

16. A ring spinning machine as set forth in claim 15 wherein said marking comprises a cam on said heart-shaped disc and said sensor is a cam-actuated switch.

17. A ring spinning machine as set forth in claim 15 which further comprises a measurement device for determining the time required for one revolution of said heart-shaped disc.

18. A ring spinning machine as set forth in claim 17 wherein said measurement device is formed by said sensor and at least partially by said control unit which, for measurement of the time of rotation, determines the time between a first detection of the angular starting position and a subsequent detection of said angular starting position.

19. A ring spinning machine as set forth in claim 15 wherein said control unit includes at least one timer responsive to the occurrence of an angular starting position of said heart-shaped disc to preset a time corresponding to a predetermined angular position.

20. A ring spinning machine as set forth in claim 15 wherein said control unit includes means for determining the time associated with a respective angular position for a lower speed of rotation by extrapolation from the time associated with the same angular position for a higher speed of rotation.

21. A ring spinning machine as set forth in claim 15 wherein said control unit includes at least one microprocessor.

22. A ring spinning machine comprising a ring rail;

at least one spindle rotatably mounted on said ring rail;

drive means connected to said ring rail for moving said ring rail through a plurality of operating vertical levels;

a rotatably mounted heart-shaped cam disc in said drive for moving said ring rail in response to rotation of said disc in a continuous transversing motion with said ring rail in a least one of said levels, said cam disc having a plurality of angular position corresponding to a plurality of machine functions to be performed;

a marking on said disc indicative of a predetermined angular starting position of said disc;

a stationary sensor for detecting said marking and generating a signal in response thereto; and a control unit connected to said sensor for receiving said signal therefrom and computing the time from said signal to at least one further predetermined angular position of said disc corresponding to a specific machine function, said control unit effecting execution of said machine function upon expiration of said computed time.

* * * * *

UNITED STATES PATENT AND TRADEMARK OFFICE

CERTIFICATE OF CORRECTION

PATENT NO. : 5,115,632

DATED : May 26, 1992

INVENTOR(S) : Georg Ulmer

It is certified that error appears in the above-identified patent and that said Letters Patent is hereby corrected as shown below:

Column 8, line 24 change "stage" to -steps-
Column 10, line 23, change "a" to --at--.

Signed and Sealed this

Third Day of August, 1993

*Attest:*

*Attesting Officer*

Michael K. Kirk

MICHAEL K. KIRK

*Acting Commissioner of Patents and Trademarks*